United States Patent [19]

Papavergos

[11] Patent Number: 4,989,675

[45] Date of Patent: Feb. 5, 1991

[54] SPRAY NOZZLE FOR FIRE CONTROL

[75] Inventor: Panayiotis G. Papavergos, Woking, England

[73] Assignee: British Petroleum Company p.l.c., London, England

[21] Appl. No.: 491,409

[22] Filed: Mar. 9, 1990

[30] Foreign Application Priority Data

Mar. 14, 1989 [GB] United Kingdom ..... 8905835

[51] Int. Cl.[5] ..... A62C 37/08

[52] U.S. Cl. ..... 169/14; 169/37; 169/62; 239/8; 239/433

[58] Field of Search ..... 169/43, 46, 53, 54, 169/62, 9, 14, 37; 239/8, 17, 399, 433; 244/118.5, 129.2

[56] References Cited

U.S. PATENT DOCUMENTS

| | | | |
|---|---|---|---|
| 2,646,314 | 7/1953 | Peeps | 299/140.1 |
| 3,393,884 | 7/1968 | Zumbiel | 244/129 |
| 3,421,693 | 1/1969 | Fraser | 239/15 |
| 3,606,154 | 9/1971 | Tufts | 239/8 |
| 3,633,822 | 1/1972 | Hruby | 239/17 |
| 4,121,790 | 10/1978 | Graham | 244/118 |
| 4,219,084 | 8/1980 | Gray et al. | 169/62 |
| 4,351,393 | 9/1982 | Tyree | 169/37 |
| 4,351,394 | 9/1982 | Enk | 169/62 |
| 4,511,087 | 4/1985 | Matsumoto | 239/433 |
| 4,516,728 | 5/1985 | Whinfrey | 239/399 |
| 4,562,966 | 1/1986 | Smith et al. | 239/433 |
| 4,568,025 | 2/1986 | McLoud | 169/37 |

FOREIGN PATENT DOCUMENTS

| | | |
|---|---|---|
| 1810816 | 6/1970 | Denmark . |
| 0092002 | 4/1982 | European Pat. Off. . |
| 0232495 | 2/1986 | European Pat. Off. . |
| 0227255 | 10/1986 | European Pat. Off. . |
| 0240377 | 2/1987 | European Pat. Off. . |
| 0314354 | 10/1988 | European Pat. Off. . |
| 2240610 | 8/1973 | France . |
| 2442640 | 12/1978 | France . |
| 63-108104 | 10/1986 | Japan . |
| 8904693 | 11/1987 | PCT Int'l Appl. . |
| 1277371 | 1/1970 | United Kingdom . |
| 1424191 | 1/1972 | United Kingdom . |
| 1404983 | 7/1972 | United Kingdom . |
| 1412133 | 10/1972 | United Kingdom . |
| 1470671 | 7/1974 | United Kingdom . |
| 1509740 | 10/1975 | United Kingdom . |
| 1585281 | 6/1977 | United Kingdom . |
| 2118037 | 4/1982 | United Kingdom . |
| 2139495 | 5/1984 | United Kingdom . |
| 2181050 | 10/1985 | United Kingdom . |
| 2171032 | 2/1986 | United Kingdom . |
| 2203829 | 4/1987 | United Kingdom . |
| 2215204 | 2/1988 | United Kingdom . |
| 2217668 | 4/1988 | United Kingdom . |
| 2211734 | 12/1988 | United Kingdom . |

OTHER PUBLICATIONS

"Passenger Protection Technology in Aircraft Accident Fires", by Nevill Birch, Contents page; Gower Technical Press, 1988.

*Primary Examiner*—Sherman Basinger
*Assistant Examiner*—Stephen P. Avila
*Attorney, Agent, or Firm*—J. G. Curatolo; L. W. Evans

[57] ABSTRACT

A spray nozzle for fire control produces a spray of gas and liquid having an oval transverse cross-section and comprises a mixing chamber having an oval transverse cross-section adapted to induce a toroidal mixing pattern in pressurized gas and liquid introduced to the mixing chamber through a plurality of inlets. In a preferred embodiment the mixing chamber is toroidal. The spray may be used in fire control systems in vehicles or other confined spaces.

14 Claims, 4 Drawing Sheets

SPRAY NOZZLE FOR FIRE CONTROL

This invention relates to a spray nozzle and in particular to a spray nozzle for fire control.

Many spray nozzles for fire control produce sprays which have a circular transverse cross-section. Use of such spray nozzles can result in wastage of liquid particularly in confined spaces or where there is limited access. For example, in fire control in corridors, the use of circular cross-section sprays can result in wastage of liquid on the walls of the corridors. Similarly, in fire control under vehicles, the use of circular cross-section sprays can result in wastage of liquid on the sides of the vehicle.

It has now been found that a gas-assisted spray nozzle which produces a spray having an oval transverse cross-section is particularly suitable for fire control.

Thus, according to the present invention there is provided a spray nozzle for fire control comprising a mixing chamber having one or more inlets for liquid and one or more inlets for gas, the mixing chamber having an oval transverse cross-section, and being adapted to induce a toroidal mixing pattern in pressurised gas and liquid introduced through the inlets and the mixing chamber having one or more outlets adapted, in use, to discharge the resultant gas/liquid mixture as a spray having an oval transverse cross-section.

An oval transverse cross-section means a cross-section having the shape of an oval. An oval is a curve that is closed and always concave towards the centre but is not a circle. Examples of ovals are a longitudinal cross-section of an egg, or an ellipse.

Toroidal means having substantially the shape of a toroid. Whereas a toroid is usually defined as a surface generated by the rotation, in space, of a circle about an axis in its plane but not cutting the circle, in the present invention toroidal means having a shape which is defined by rotation, in space, of a shape (longitudinal half cross-section) along the path of an oval in a plane parpendicular to the plane of the shape and in the present invention also means having a similar shape which is equivalent in effect. The longitudinal half cross-section may be a circle but other shapes may be used. The longitudinal half cross-section may be uniform or non-uniform around the toroid.

Preferably, the mixing chamber is toroidal as hereinbefore defined with an oval transverse cross-section. Preferably, the inner surfaces of the mixing chamber aids mixing of gas and liquid introduced through the inlets. The mixing chamber may have an elliptical transverse cross-section. The mixing chamber may be toroidal with a circular half longitudinal cross-section and the diameter of the circular half longitudinal cross-section may vary around the mixing chamber. The mixing chamber may have the shape of a toroid as hereinbefore defined, with one or more radially interconnecting cavities or passages.

Preferably, the inlets are directed so that gas and liquid introduced through the inlets impinging on one another to mix within the mixing chamber and to avoid unmixed gas or liquid leaving the mixing chamber. The inlets may be directed so that they are not directly aligned with the outlets to avoid unmixed gas or liquid leaving the mixing chamber. If some of the inlets are directly aligned with the outlets then, preferably in use, the flow of gas or liquid through the other inlets is selected to deflect the flow of gas or liquid through those inlets to avoid unmixed gas or liquid leaving the mixing chamber. Preferably, the gas and liquid inlets are disposed circumferentially around the mixing chamber. The one or more liquid inlets may be radially outside the one or more gas inlets or the one or more gas inlets may be radially outside the one or more liquid inlets. There may be more radially outer inlets than radially inner inlets. The inlets may be circular or slot shaped.

The mixing chamber may have a single slot-shaped outlet aligned with the elongation of the oval mixing chamber. The mixing chamber may have a plurality of outlets disposed circumferentially around the mixing chamber in an oval arrangement aligned with the oval transverse cross-section of the mixing chamber.

Without wishing to be bound by any theory, it is believed that the gas and liquid introduced to the spray nozzle interact by shearing to produce the toroidal mixing pattern. The degree of shear and mixing in the mixing chamber affects the quality of the resultant spray, that is drop size and the like and may be selected according to the application by suitable design of the nozzle Also according to the present invention there is provided a method of fire control comprising supplying separately and at pressure, gas and non-flammable liquid to a spray nozzle as herein described and directing the resultant spray emerging from the one or more outlets to control the fire.

Fire control may comprise one or more of the following activities; extinguishing a fire, limiting the development or spread of a fire, cooling the fire and its environs, cooling areas adjacent to the fire, and in particular increasing survivability of an enclosed space by stripping smoke, fumes, acid gases and the like from the space and reducing flame radiation intensity and other activities. The apparatus and method of the present invention are particularly suitable for liquid hydrocarbon fires.

It is believed that when a spray produced by the apparatus and method of the present invention is directed at a fire in fire control the spray has the necessary throw to effect satisfactory fire penetration and that the drops, although they lose weight due to evaporation on leaving the nozzle and before reaching the fire core, retain their liquid state as they reach the fire core. This allows substantial heat absorption from the fire as the liquid drops evaporate, particularly in the case of water based liquids having a high latent heat of evaporation and high heat capacity. It is believed that the water-based spray, in addition to providing a large and rapid reduction in temperature of the fire core, also, once it has changed to vapour in the hot environment, provides water molecules which may narrow the flammability limits of the combustibles in the fire core by inhibiting the combustion reactions at the molecular level. It is also believed that the temperature reduction effect helps prevent re-ignition of the fire. For liquid hydrocarbon based fires, formation of a water-oil emulsion, which may be enhanced by stripped smoke particles, may also prevent re-ignition.

In the method and apparatus of the present invention, the gas is preferably air but other gases such as nitrogen, carbon dioxide flare gas or mixtures of air and nitrogen or even halogenated hydrocarbons, for example Halon (Trade Mark) may be used. Preferably, the liquid is water or a water solution, for example, water solutions containing fire suppressants or dousing agents or salt water. However, other liquids may be used such as non-flammable fire extinguishing liquids.

One or more spray nozzles, according to the present invention may be used in fixed installations, for example in buildings or vehicles, in semi-portable installations, for example fire control hoses or in portable equipment, for example portable fire extinguishers.

Also according to the present invention there is provided a fire control system comprising a plurality of spray nozzles as hereindescribed and means for supplying separately and at pressure, gas and non-flammable liquid to the spray nozzles.

In use, the spray nozzle according to the present invention produces a spray having an oval transverse cross-section which may be directed to control a fire without undue wastage of the spray. In particular, one or more spray nozzles according to the present invention may be used to provide a spray curtain for fire control. Thus, the spray may be directed in front of doors or windows to prevent ingress of an external fire. The spray may be directed along corridors without excessive wastage of the spray on the walls which might occur with a spray having a circular transverse cross-section.

The relatively small amount of liquid required by the spray nozzle according to the present invention makes it particularly suitable for use in vehicles and the like where a limited amount of liquid is available. In this application the liquid supply for the spray may be derived from the on-board water supply to allow operation when the vehicle is in motion. The gas supply may be similarly derived from the vehicle's own compressed air supply. Vehicles to which this invention may be applied include trains and their rolling stock, tanks and armoured vehicles and the like, ships, hovercraft, submarines, on-shore and off-shore modules, oil rigs and, most preferably, aircraft. The liquid may be supplied at pressure by means of pressurised gas from a receiver in the event of power failure in the vehicle. The limited amount of liquid available and the compressed gas supply on the vehicle may be augmented by the emergency services upon their arrival, in addition to the conventional fire control procedures that would be implemented. Compressed gas may be supplied by an emergency service vehicle using a compressor powered by the emergency vehicle's pressurised water supply.

The present invention may also bs applied to confined spaces where the use of excessive amounts of liquid, such as might be required in conventional fire control, is to ba avoided or is not available, for example tunnels, mines and other underground workings. The spray nozzles may be provided as fixtures within the tunnel itself, or may be associated with vehicles travelling through the tunnel.

The present invention may also be applied where it is desirable to minimise damage due to excess liquid usage, for example hotels, warehouses, computer and instrumentation rooms and the like.

The invention will now be described by way of example only and with reference to the drawings in which FIG. 1 represents in longitudinal cross-section a spray nozzle according to the present invention and FIG. 2 represents, in transverse cross-section viewed on line X—X, the same nozzle as in FIG. 1.

Figure 1:
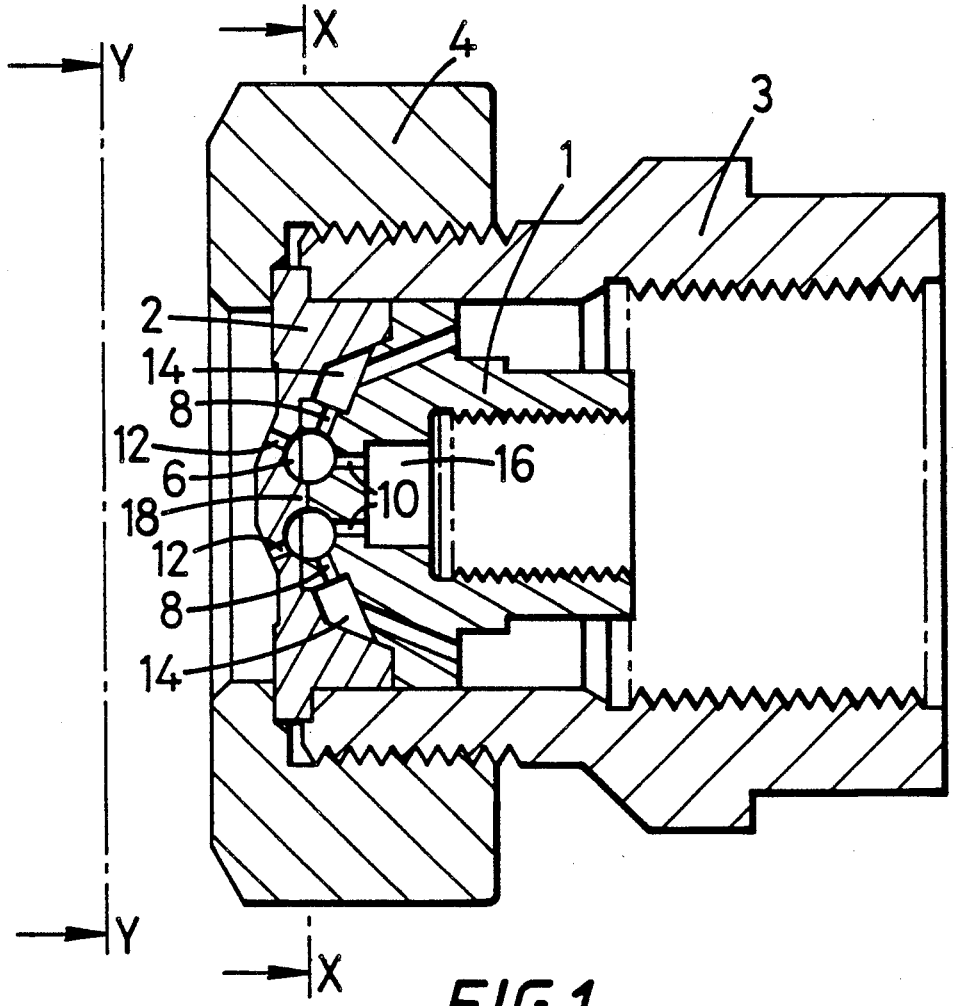
Figure 2:
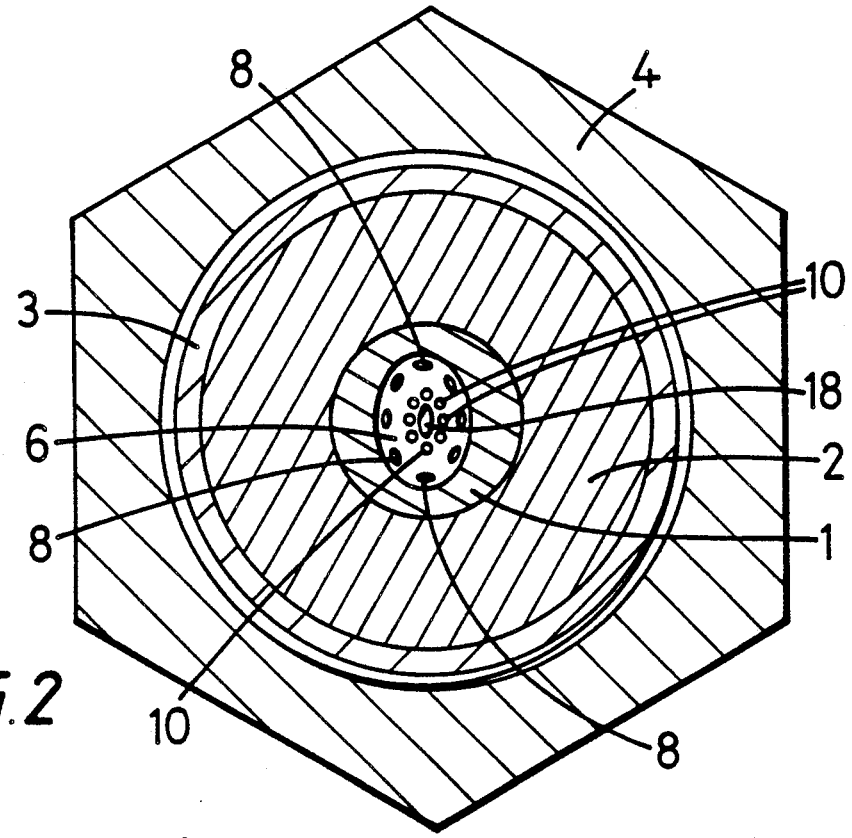
Figure 3:
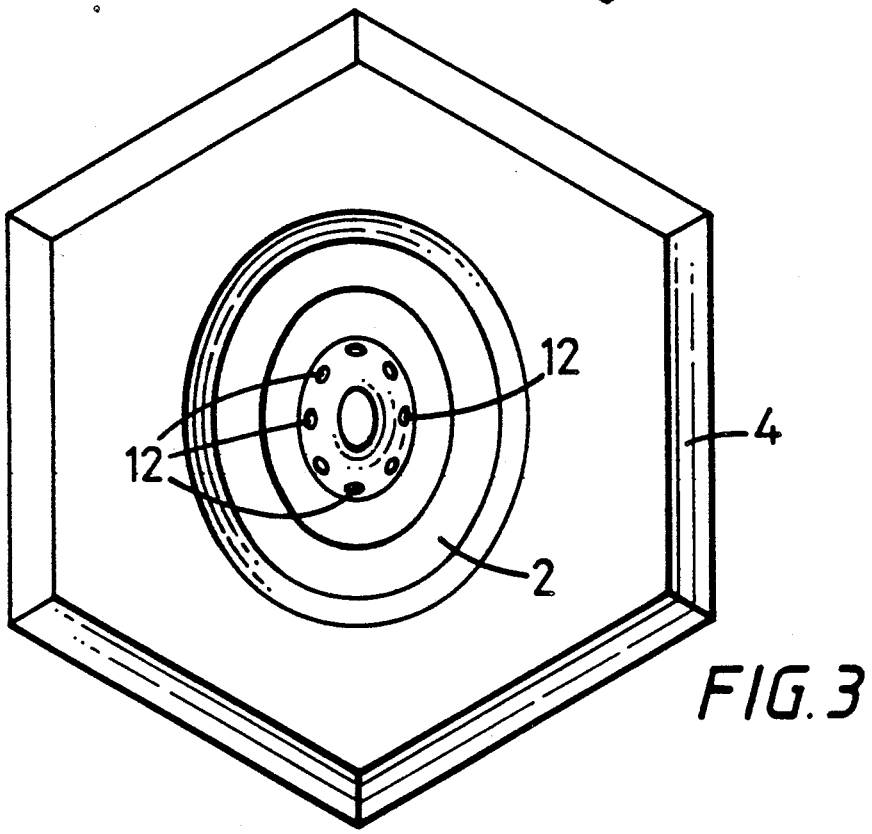
FIG. 3 represents an end view on line Y—Y of the nozzle in FIG. 1.
Figure 4:
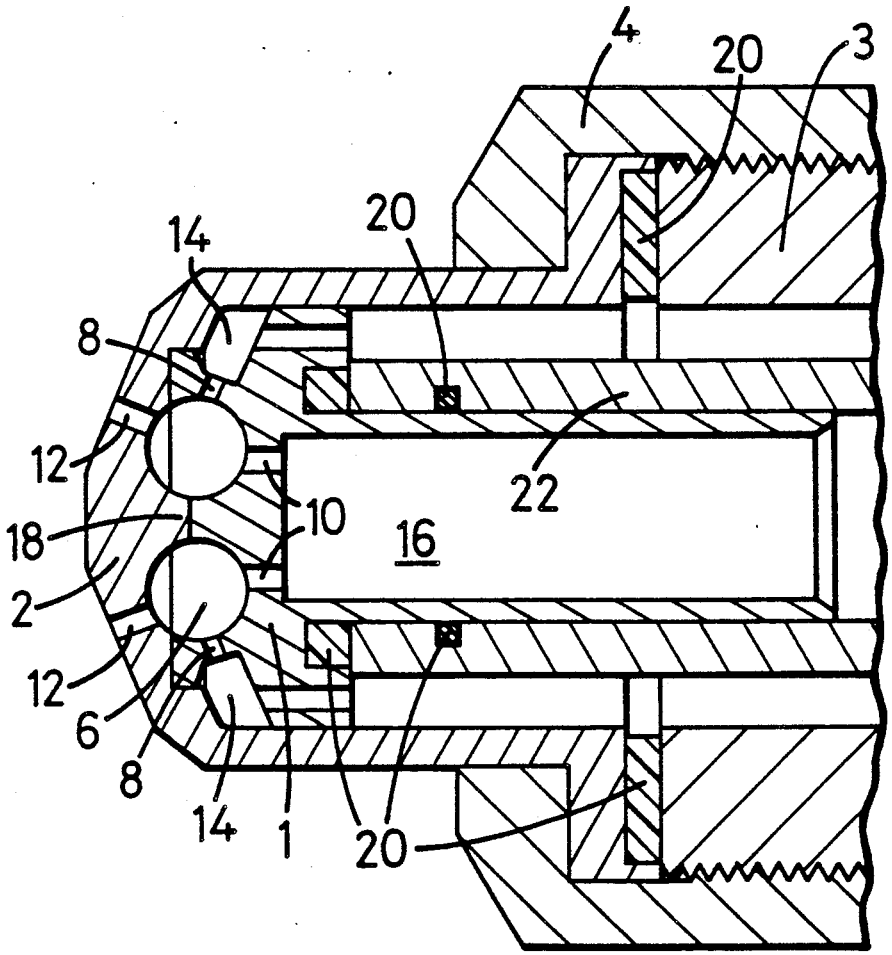
Figure 4 represents in longitudinal cross-section a spray nozzle similar to that in FIGS. 1 to 3 and FIG. 5 represents in longitudinal cross-section a spray nozzle according to the present invention in which the mixing chamber is toroidal with a central cavity.
Figure 5:
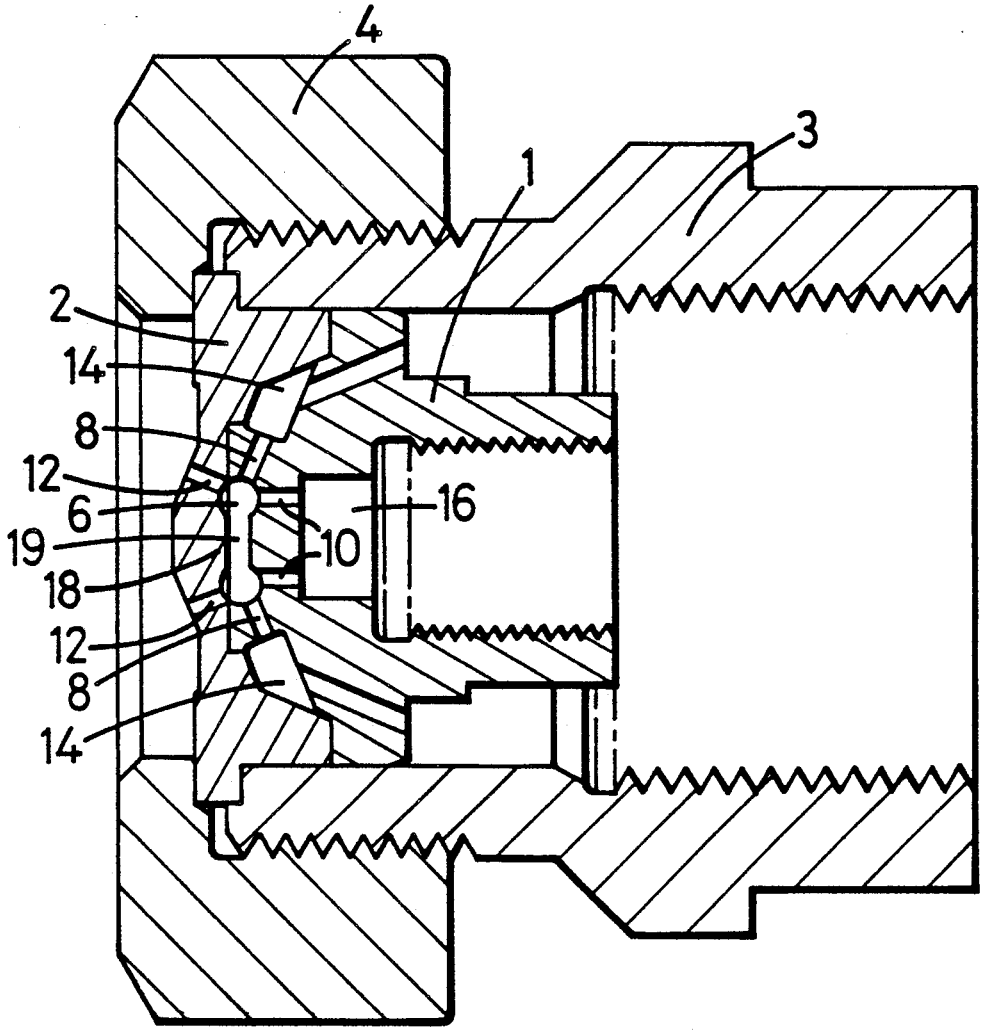

In FIGS. 1 to 5 each spray nozzle according to the present invention comprises two parts (1,2) which may be held together by a barrel (3) in threaded engagement with locking nut (4). To ensure correct alignment of the parts they may have a key and groove (not shown). The nozzle in FIG. 4 is shown with 0-ring seals (20) between the parts of the nozzle and a further inner barrel part (22). With the two parts (1,2) assembled they define therebetween a mixing chamber (6) having an oval transverse cross-section in the direction X—X of FIG. 1. In FIGS. 1 to 4 the mixing chamber is toroidal with a circular half longitudinal cross-section. That is to say, the shape of the mixing chamber is defined by a circle moved through an oval path in a plane perpendicular to the plane of the circle. In FIGS. 1 to 3 the circular half longitudinal cross-section is not uniform around the toroid, the circle having different diameters around the toroid so that the radial width of the toroid is non uniform. FIG. 5 shows a longitudinal cross-section of a spray nozzle similar to that in FIGS. 1 to 3 according to the present invention in which the mixing chamber is a toroid with the centre (18) partially removed to provide a central cavity (19). The circular longitudinal cross-section in FIG. 5 is smaller than that in FIG. 1 so that the overall mixing chamber volume is the same for the two nozzles. In FIGS 1 to 5 each mixing chamber (6) has a plurality of (in this case eight) gas inlets (8) and an equal number of liquid inlets (10) which are disposed circumferentially around the mixing chamber. The gas and liquid inlets (8,10) are directed so that gas and liquid introduced through the inlets impinge on one another. Each mixing chamber has eight outlets (12) disposed circumferentially around one end of the mixing chamber so that they are not directly aligned with the gas or liquid inlets. The outlets are in an oval arrangement corresponding to the shape of the mixing chamber. Each spray nozzle also has an annular gas supply passage (14) and has a liquid supply passage (16).

In use gas, for example air, is supplied at pressure through the annular supply passage (14) and the gas inlets (8) to the mixing chamber (6) of the assembled nozzle. Liquid, for example water, is supplied at pressure through the supply passage (16) and the liquid inlets (10). The gas and liquid impinge and shear one another initiating spray formation and mix in a toroidal mixing pattern inside the mixing chamber before leaving through the outlets (12) in the form of a spray having an oval transverse cross-section.

The spray produced by these spray nozzles may bs used in a method of fire control, for example by being directed to produce a spray curtain along a passageway or in front of a door to control a fire.

I claim:

1. A spray nozzle for fire control comprising a body defining a mixing chamber having an oval transverse cross-section, said mixing chamber having:

(a) at least one inlet for pressurised liquid, (b) at least one inlet for pressurised gas, and (c) at least one outlet, said mixing chamber being adapted to mix, in a toroidal mixing pattern, pressurised gas and pressurised liquid introduced through said inlets to form a gas/liquid mixture, and said at least one outlet being adapted to discharge said mixture as a spray having an oval transverse cross-section.

2. A spray nozzle according to claim 1 in which said mixing chamber has a toroidal shape with an oval transverse cross-section.

3. A spray according to claim 2 in which said mixing chamber has a toroidal shape with a circular half longitudinal cross-section.

4. A spray nozzle according to claim 3 in which said circular half longitudinal cross-section has a diameter which varies around said mixing chamber.

5. A spray nozzle according to claim 2 in which said mixing chamber has radially interconnecting cavities.

6. A spray nozzle according to claim 2 in which said inlets are directed so that, in use, gas and liquid introduced through said inlets impinge on one another.

7. A spray nozzle according to claim 2 in which said inlets are disposed circumferentially around said mixing chamber.

8. A spray nozzle according to claim 7 in which said mixing chamber has more radially outer inlets than radially inner inlets.

9. A spray nozzle according to claim 2 in which said mixing chamber has a single slot-shaped outlet.

10. A spray nozzle according to claim 2 in which said mixing chamber has a plurality of outlets disposed circumferentially around said mixing chamber in an oval arrangement aligned with said oval transverse cross-section of said mixing chamber.

11. A spray nozzle according to claim 2 in which said body is adapted to be fitted in a vehicle.

12. A spray nozzle according to claim 11 in which said vehicle comprises a train, aircraft or ship.

13. A fire control system comprising a plurality of spray nozzles according to claim 1 and means for supplying separately and at pressure, gas and non-flammable liquid to said inlets of said spray nozzles.

14. A method of fire control comprising the steps of:

(a) supplying separately and at pressure gas and non-flammable liquid to a spray nozzle comprising a body defining a mixing chamber having an oval transverse cross-section, said mixing chamber having:

(i) at least one inlet for pressurised liquid, (ii) at least one inlet for pressurised gas, and (iii) at least one outlet, said mixing chamber being adapted to mix, in a toroidal mixing pattern, said pressurised gas and pressurised liquid introduced through said inlets to form a gas/liquid mixture, and said at least one outlet being adapted to discharge said mixture as a spray having an oval transverse cross-section and (b) directing said spray emerging from said at least one outlet to control said fire.

* * * * *